US006552638B2

(12) United States Patent
Rhodes

(10) Patent No.: US 6,552,638 B2
(45) Date of Patent: Apr. 22, 2003

(54) SEMI-SOLID LINK SOLENOID

(75) Inventor: Kathleen B. Rhodes, Anderson, IN (US)

(73) Assignee: Delco Remy America, Inc., Anderson, IN (US)

( * ) Notice: Subject to any disclaimer, the term of this patent is extended or adjusted under 35 U.S.C. 154(b) by 0 days.

(21) Appl. No.: 09/903,317

(22) Filed: Jul. 11, 2001

(65) Prior Publication Data

US 2002/0005771 A1 Jan. 17, 2002

Related U.S. Application Data

(60) Provisional application No. 60/217,756, filed on Jul. 12, 2000.

(51) Int. Cl.[7] ..... H01H 67/02
(52) U.S. Cl. ..... 335/126; 335/131
(58) Field of Search ..... 335/126, 131, 335/255–256

(56) References Cited

U.S. PATENT DOCUMENTS 4,825,180 A * 4/1989 Miyaji ..... 335/131
5,892,422 A * 4/1999 Montaigu et al. ..... 335/126
5,894,256 A * 4/1999 Kobayashi et al. ..... 335/126

* cited by examiner

*Primary Examiner*—Lincoln Donovan
(74) *Attorney, Agent, or Firm*—Ice Miller; Russell E. Fowler, II

(57) ABSTRACT

A semi-solid link solenoid 10 comprises windings 22 held within a housing 20, and a spring biased plunger 24 which is free to slide axially within the windings. The plunger 24 slideably engages a contact rod 26 having an end knob 58. The end knob 58 of the contact rod 26 is contained within a center chamber 46 of the plunger 24 between a shoulder 47 and an abutment pin 50. A contact disc 28 is fixed to an opposite end of the contact rod 26. When the windings are energized and the plunger is pulled completely into the windings, the contact disc 28 is forced into contact with the terminals 30*a* and 30*b*. After electric current is removed from the windings, the plunger returns to its non-energized position. When returning to this position, the shoulder 47 slams against the end knob 58 with a large amount of force to pull the contact rod 26 and contact disc 28 away from the terminals 30*a* and 30*b*. In this manner, the force to disengage the contact disc 28 from the terminals 30*a* and 30*b* is significantly increased.

20 Claims, 2 Drawing Sheets

SEMI-SOLID LINK SOLENOID

CROSS REFERENCE TO RELATED APPLICATIONS

This application claims the benefit of U.S. Provisional Application No. 60/217,756, filed Jul. 12, 2000.

BACKGROUND

A typical automobile engine starter includes a solenoid that is activated upon closing an ignition switch. As shown in FIG. 1, the solenoid includes two terminals 30*a* and 30*b*, a contact disc 28, a contact rod 26, a plunger 24, and windings 22. The contact disc 28 is connected to the contact rod 26 and biased by a return spring 66 away from the terminals 30*a* and 30*b*. The plunger 24 is separated from the contact rod 26 across an air gap 29. A rod 52 on the plunger 24 is connected to one end of a shift lever 80. The opposite end of the shift lever 80 is connected to a pinion 82. The pinion 82 is generally in some slideable relationship to the drive shaft 84 of an armature 88.

The operator of an automobile cranks the engine by turning a key or pressing a button that closes an ignition switch (not shown). When the ignition switch is closed and electric current is provided to the solenoid windings 22. Upon excitation of the solenoid, the plunger 24 moves into the body of the solenoid. This causes the shift lever to rotate about its pivot point 81. Rotation of the lever 80 about the pivot point causes the lever to move the pinion 82 linearly in the direction of arrow 86, sliding the pinion towards the engine flywheel ring gear (not shown). Upon reaching the ring gear, the teeth of the pinion 82 mesh with the teeth of the ring gear. Subsequent rotation of the pinion 82 will rotate the ring gear and crank the automobile engine.

As the pinion 82 is forced toward the ring gear, as a result of solenoid plunger movement, the plunger 24 moves linearly in the direction of arrow 87 to reduce a magnetic air gap 31 within the solenoid. Plunger movement toward the terminals brings the plunger into contact with the contact rod 26. As a result of plunger movement, the contact rod 26 and connected contact disc 28 are moved in the direction of the terminals 30*a* and 30*b* until the contact disc 28 comes into contact with the terminals 30*a* and 30*b*. When the contact disc 28 physically touches the terminals 30*a* and 30*b*, an electric circuit is completed which provides cranking current to drive the armature. Energization and subsequent rotation of the armature transmits rotational power to the drive shaft 84 and pinion 82. Rotation of the pinion 82 and ring gear transmits rotational force to a crankshaft (not shown) which causes the automobile engine to rotate as part of the starting cycle.

After the engine has fired, the driver generally releases the key, causing the ignition switch to open, and current is no longer provided to the solenoid windings 22. When the solenoid is no longer excited by electric current, a plunger biasing spring 42 pulls the plunger 24 away from the terminals 30*a* and 30*b* and back to its non-excited position. With the plunger 24 no longer abutted against the contact rod 26, the return spring 66 forces the contact disc 28 and contact rod 26 away from the terminals 30*a* and 30*b*.

In the making and breaking of cranking currents there is a partial welding/fusing or co-joining of materials between the contact disc and the terminals. Under most normal circumstances, the return spring 66 maintains enough force to disjoin or mechanically break this partial fusing of materials. However, there exists a potential for fusing strength in excess of the available return spring 66 force.

This potential is influenced by many factors relating to overall starting system and application integrity both new and over the life cycle of the vehicle. When the return spring 66 force is exceeded by the fused material strength of the contact to terminals the starter armature will continue to be energized after the operator releases the ignition switch. When this happens, the armature will continue to run even after the vehicle engine has fired and the pinion has disengaged the ring gear. Continuous running of the armature absorbs a great deal of electrical energy from the battery, making less electrical energy available for other automobile systems. If the armature runs for too long, it may completely drain the battery. Furthermore, because the armature is not intended to run for a long period of time, extended running of the armature may cause it to over heat and cease to function. For the foregoing reasons there is a need for a solenoid that significantly reduces the susceptibility of starter failure as a result of contact welding/fusing.

SUMMARY

The present invention is directed to an apparatus that satisfies the need for a solenoid that significantly reduces the susceptibility of starter (also referred to herein as a starter motor) to failure as a result of contact welding/fusing. The apparatus comprises a solenoid having a bobbin and a winding for receiving electric current. A plunger is positioned in electromagnetic communication with the winding such that energizing the winding with current will cause the plunger to slide within the bobbin in one direction. A plunger biasing spring causes the plunger to slide in the opposite direction when electric current is removed from the winding.

The plunger includes a center cavity extending axially within the plunger. The center cavity includes a shoulder at one end which defines an axial bore having a smaller diameter than the center cavity. An opposite end of the center cavity is defined by an abutment pin positioned in a slot extending perpendicularly through the center cavity.

An impact device is slideably positioned in the center cavity of the plunger. The impact device is bounded in the center cavity of the plunger by the shoulder and the abutment pin. The impact device is connected to one end of a contact rod which extends in a slideable relationship through the axial bore of the plunger. The opposite end of the contact rod holds a contact. Thus, the impact device is in communication with the contact through the mechanical link of the contact rod. Movement of the impact device in one direction will cause the contact to move in that direction and, likewise, movement of the impact device in the opposite direction will cause the contact to move in that opposite direction. The contact generally moves toward a set of terminals to establish a connection between the contact and terminals or away from the set of terminals to break a connection between the contact and terminals.

When the winding is energized, the pinion moves further into the bobbin. This movement of the plunger causes the abutment pin to contact the impact device and move it toward the terminals. Movement of the impact device toward the terminals also moves the contact and establishes a connection between the contact and the terminals. Removing electric current from the winding will result in the plunger biasing spring causing the plunger to slide within the bobbin in a direction away from the terminals. When the plunger moves in this direction, the shoulder of the plunger slams into the impact device and carries the impact device in the direction of plunger movement. Movement of the impact device away from the terminals pulls the contact rod and contact away from the terminals and forcefully breaks the established connection between the contact and terminals. Because of this forceful separation of the contact from the terminals, the susceptibility of starter failure resulting from contact welding/fusing is significantly reduced. These and other features, aspects and advantages of the present invention will become better understood with reference to the following description and appended claims.

DESCRIPTION

Figure 1:
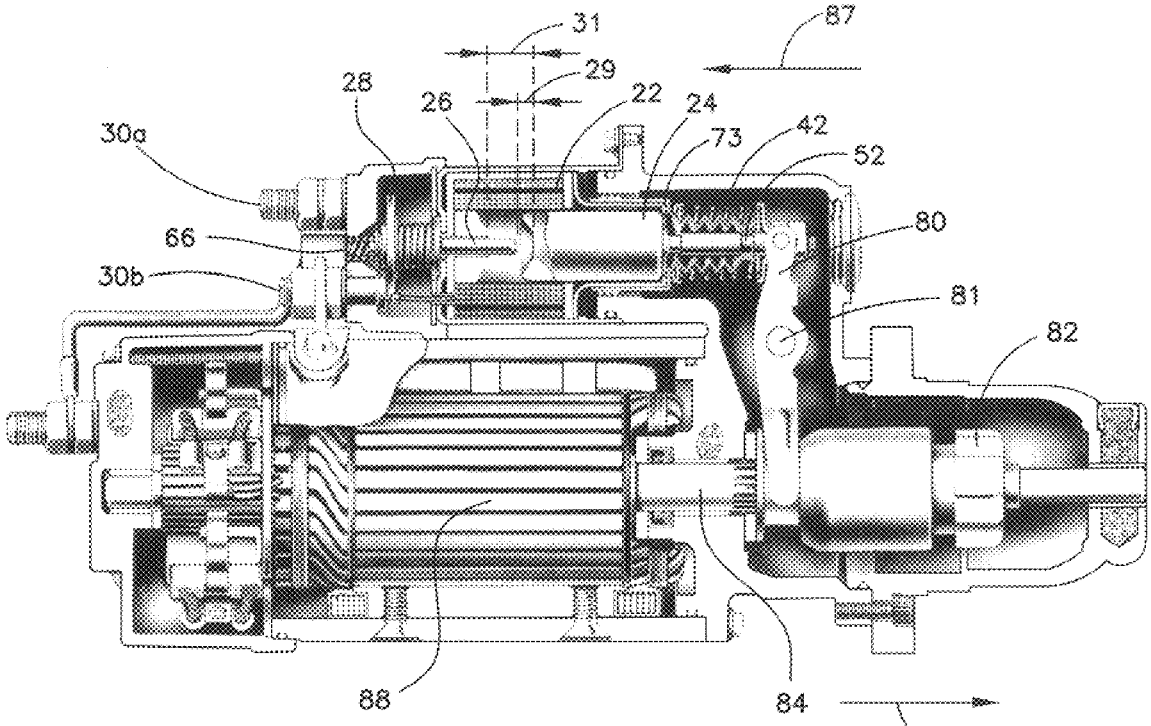
FIG. 1 is a cross-sectional view of a conventional solenoid in a typical automobile starter.
Figure 2:
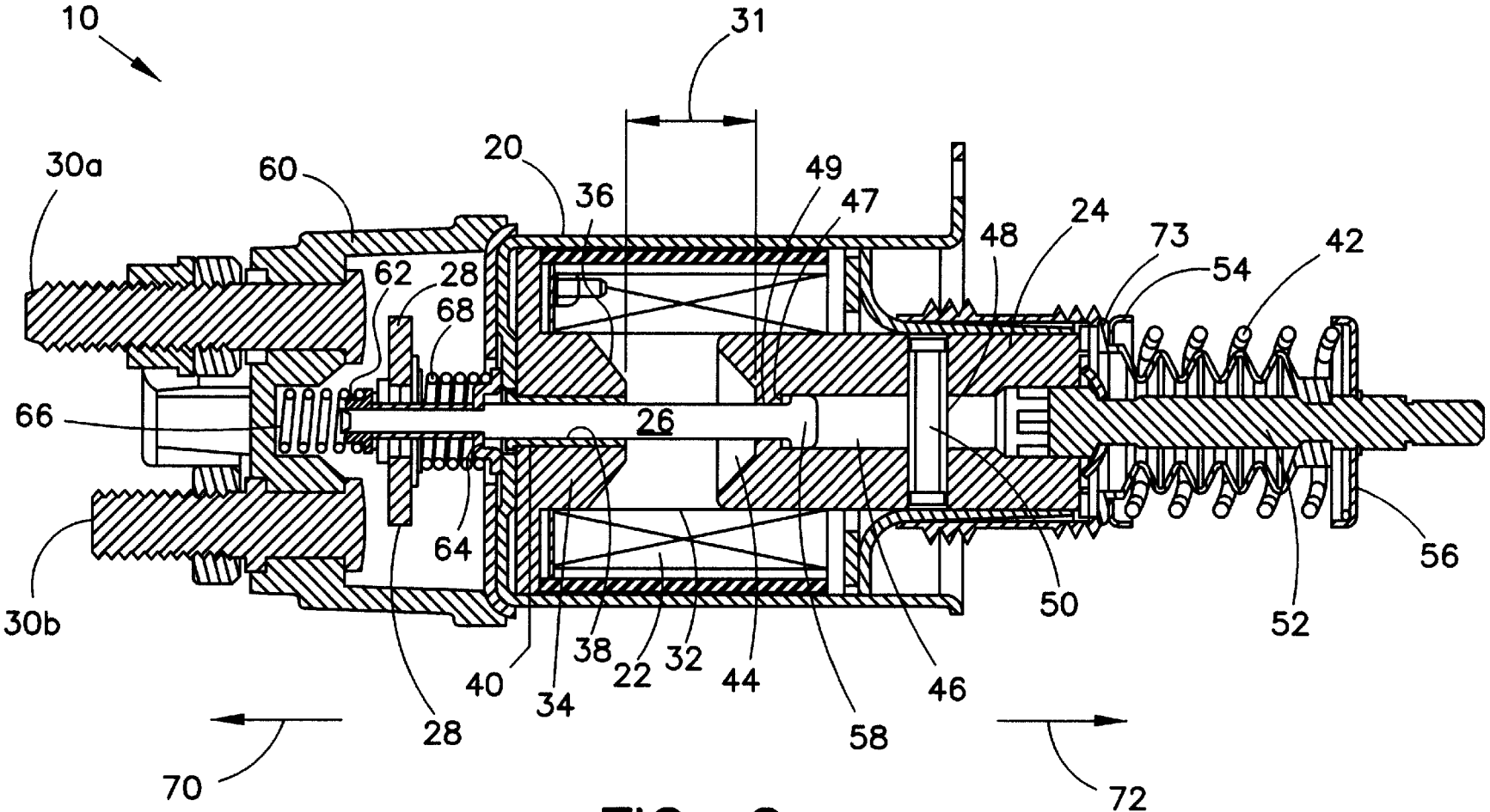
FIG. 2 is a cross-sectional view of the semi-solid link solenoid.

As shown in FIG. 2, a semi-solid link solenoid 10 comprises windings 22 held within a housing 20, and a spring biased plunger 24 which is free to slide axially within the windings. The plunger slideably engages a contact rod 26 having an end knob 58. The end knob 58 of the contact rod 26 is contained within a center chamber 46 of the plunger 24 between a shoulder 47 and an abutment pin 50. A contact disc 28 is fixed to an opposite end of the contact rod 26. When the windings are energized and the plunger is pulled completely into the windings, the contact disc 28 is forced into contact with the terminals 30*a* and 30*b*. After electric current is removed from the windings, a plunger biasing spring 42 causes the plunger to return to its non-energized position. When returning to this position, the shoulder 47 impacts the end knob 58 with a large amount of force to pull the contact rod 26 and contact disc 28 away from the terminals 30*a* and 30*b*. In this manner, the force exerted on the closed connection of the contact disc 28 and terminals 30*a* and 30*b* is much greater than in previous solenoid designs. Therefore there is a high probability that the contact disc 28 can be successfully separated form the terminals 30*a* and 30*b*, and the contact disc will not remain welded to the terminals.

The solenoid windings 22 are held within the housing 20 on a sleeve or bobbin 32. The windings 22 are typically made of copper wire. When an ignition switch (not shown) is closed, the windings 22 are provided with a source of electric current from a current source (not shown), such as a battery. A plunger stop 34, or backstop, is positioned at one end of the bobbin 32 and extends axially into the bobbin. The plunger stop 34 includes a center bore 38 holding a plunger stop bushing 40. The plunger stop 34 also includes a chambered end 36 adapted to receive the plunger 24. The plunger stop 34 is made of a ferromagnetic material which is magnetized when electric current is applied to the windings.

The plunger 24 is also made of a ferromagnetic material and is positioned within the bobbin 32 opposite the plunger stop 34. The plunger 24 is in electromagnetic communication with the windings, as the plunger is made of material that will produce an electromagnetic reaction to electric current flowing through the windings. The plunger includes a recessed end 44 designed to fit against the chambered end 36 of the plunger stop 34. An axial air gap 31 is defined as the distance between the plunger stop 34 and the plunger 24. The plunger 24 is free to slide axially within the bobbin between the plunger stop 34 and an end plate 73.

The plunger 24 further includes a center chamber 46 formed axially within the plunger. The center chamber 46 includes a shoulder 47 which defines an axial bore 49 between the center chamber 46 and the recessed end 44. The axial bore 49 provides a passage from the exterior of the plunger to the center chamber 46. A slot 48 extends through the plunger, perpendicular to the center chamber 46. An abutment pin 50 is secured within the slot 48 and perpendicularly intersects the center chamber 46.

A plunger rod 52 extends axially from the plunger 24 in the direction of arrow 72. A first plunger spring retainer 54 is positioned against the end plate 73, concentric with the plunger rod 52. A second plunger spring retainer 56 is fixed to the far end of the plunger rod 52. The plunger return spring is situated between the first plunger spring retainer 54 and second plunger spring retainer 56. As the plunger 24 slides within the: bobbin 32, the plunger rod 52 moves with the plunger. As the rod moves, the first plunger spring retainer 54 remains stationary to the end plate 73, but the second plunger spring retainer 56 moves with the rod and plunger. Thus, as the plunger moves, the plunger return spring 42 is compressed or decompressed between the first and second plunger spring retainers.

The contact rod 26 is slideably engaged with and extends through the center bore 38 of the plunger stop 34 riding on the bushing 40. The contact rod 26 is also slideably engaged with and extends through the axial bore 49 and into the center chamber 46 of the plunger 24. The end of the contact rod 26 that extends into the plunger's center chamber 46 includes an impact device in the form of a knob 58. The knob is dimensioned to slide within the center chamber 46 of the plunger between the shoulder 47 and the abutment pin 50. Thus, movement of the knob 58 within the center chamber is bounded by the shoulder 47 and the abutment pin 50.

A solenoid cap 60 is attached to the solenoid housing 20 on the end of the housing adjacent to the plunger stop 34. The solenoid cap 60 includes the terminals 30*a* and 30*b* mounted upon the cap. The solenoid cap 60 surrounds the contact disc 28 which is slideably positioned upon the end of the contact rod 26. The terminals 30*a* and 30*b* are positioned across from the contact disc 28 such that the contact disc may be moved in the direction of axial plunger movement to bring the contact disc into contact with both terminals. The solenoid cap 60 is easily removed from the solenoid housing 20 to reveal the contact disc 28 should the terminals need to be repaired.

The contact rod 26 further includes a return spring retainer 62 fixed between the contact disc 28 and the terminal end of the contact rod. A return spring 66 is situated between the solenoid cap 60 and the return spring retainer 62. The return spring 66 biases the contact rod 26 and associated contact disc 28 away from the terminals 30*a* and 30*b*. An overtravel spring 68 is situated between the contact disc 28 and an overtravel spring retainer 64 which abuts against the housing. The overtravel spring allows the plunger and contact rod 26 to travel further in the direction of arrow 70 following switch closure and provides a force to limit the disc oscillations during switch closure.

In operation, an operator desiring to start an engine turns a key associated with an ignition switch, thus causing the battery to deliver electric current to the windings 22 of the semi-solid link solenoid 10. The energized solenoid windings cause the plunger 24 to move in the axial direction with respect to the windings, i.e., in the direction of arrow 70, toward the plunger stop 34. As the plunger 24 moves toward the plunger stop 34, the contact rod 26 remains stationary until the abutment pin 50 contacts the knob 58. After the abutment pin 50 contacts the knob 58, the contact rod 26 is forced to move axially, in the direction of arrow 70, with the plunger 24 until the plunger comes to rest against the plunger stop 34. As the contact rod moves with the plunger, the contact disc 28 is forced into contact with terminals 30*a* and 30*b*. After the contact disc engages the terminals, the contact rod 26 moves slightly further in the direction of arrow 70. During this time, the overtravel spring 68 compresses against the overtravel spring retainer 64 which moves along with the contact rod. At the same time, the return spring 66 is compressed between the cap 60 and the return spring retainer 62. Contact rod movement is completely stopped when the plunger recessed end 44 meets the chambered end 36 of the plunger stop 34.

With the contact disc 28 in connection with the terminals 30*a* and 30*b*, an electric circuit is completed for the starting motor, and electric current flows from terminal 30*a*, through the contact disc 28, and into terminal 30*b*. Delivery of electric current to the starting motor causes the starting motor drive shaft to rotate. Rotation of the starting motor drive shaft turns the pinion, which is in communication with the ring gear, and the engine is cranked. Once the operator hears the engine fire and start, the key is released and the ignition switch is opened, thus depriving the windings 22 of electric current. The non-energized windings 22 no longer cause the plunger 24 to be attracted to plunger stop 34, and the plunger biasing spring 42 forces the plunger 24 to move axially away from the plunger stop 34, in the direction of arrow 72.

As the plunger 24 moves away from the plunger stop 34, the compressed return spring 66 applies pressure to the contact rod 26 to encourage the contact disc 28 away from the terminals 30*a* and 30*b*. In normal operation the return spring 66 pressure is adequate enough to separate the contact disc from the terminals 30*a* and 30*b*. However, if the contact terminal fusion phenomenon results in a fused joint of significant strength, the return spring 66 may not have enough force to cause successful separation.

If the fused joint strength exceeds the force available from the return spring 66, the semi-solid link solenoid 10 provides a mechanism to remove the contact disc from the terminals. Specifically, as the plunger 24 accelerates away from the plunger stop 34 in the direction of arrow 72 under the influence of the plunger biasing spring 42, the shoulder 47 of the plunger's center chamber 46 impacts the knob 58 on the end of the contact rod 26. This action upon the contact rod 26 imparts an instantaneous force to assist in the removal of the contact disc 28 from the terminals 30*a* and 30*b*. As the contact rod knob 58 is forcefully pulled along with the plunger away from the terminals in the direction of arrow 72, the contact disc 28 is removed from the terminals 30*a* and 30*b* overcoming the strength of the fused joint.

The above described versions of the present invention have many advantages including, but not limited to, increasing the successful separation of contact and terminals thus severely reducing the likelihood of starter failure due to welded contacts. Although the present invention has been described in considerable detail with reference to certain preferred versions thereof, other versions are possible. For example, instead of using an abutment pin 50 to contact the knob 58 of the contact rod 26 and encourage the contact rod in the direction of arrow 70, the contact rod could include an alternative member positioned upon the contact rod between the knob and the portion of the contact rod that extends through the center bore 38 of the plunger stop 34. With such an alternative member, the shoulder 47 of the plunger would contact the alternative member and encourage the contact rod in the direction of arrow 70. Similarly, instead of using the knob as an impact device, an alternative impact device may be used such as a circular or wedge-shaped impact device. Furthermore, instead of using a contact rod to communicate between the impact device and the contact and encourage removal of the contact from the terminals, an alternative communication device could be used, such as a flexible line or a plurality of rods extending from the plunger to the contact. Therefore, the spirit and scope of the appended claims should not be limited to the description of the preferred versions contained herein.

What is claimed is:

1. A solenoid for making and breaking a connection between a contact and at least one terminal, the solenoid comprising:

(a) a winding for receiving electric current;

(b) a moveable plunger positioned in electromagnetic communication with the winding, the plunger having a center cavity, movement of the plunger in a first direction causing the connection between the contact and the terminals to be made, and movement of the plunger in a second direction causing the connection between the contact and the at least one terminal to be broken;

(c) an abutment pin positioned in the center cavity of the plunger; and (d) an impact device in communication with the contact, the impact device positioned in the center cavity to impact the abutment pin when the plunger moves in the first direction and impact the plunger when the plunger moves in the second direction.

2. The solenoid of claim 1 wherein a contact rod provides the communication between the impact device and the contact.

3. The solenoid of claim 2 wherein the impact device is positioned at one end of the contact rod and the contact is positioned at an opposite end of the contact rod.

4. The solenoid of claim 3 wherein the impact device is a knob.

5. The solenoid of claim 3 wherein the plunger includes at least one slot and the abutment pin is positioned in the slot.

6. The solenoid of claim 5 wherein the center cavity is bounded by a shoulder formed in the plunger, and the impact device is bounded in the center cavity by the shoulder formed in the plunger and the abutment pin.

7. The solenoid of claim 6 wherein the shoulder defines an axial bore for receiving the contact rod.

8. The solenoid of claim 3 wherein the contact is moveably positioned upon the opposite end of the impact device and biased toward the opposite end of the contact rod by a spring.

9. A method of breaking the connection between a contact and at least one terminal of a solenoid comprising the steps of:

(a) providing a winding for receiving electric current;

(b) providing a moveable plunger positioned in electromagnetic communication with the winding, the plunger having a center cavity with an abutment pin extending through the center cavity;

(c) providing an impact device in communication with the contact;

(d) moving the plunger in a first direction to cause the impact device to strike the abutment pin, thereby moving the impact device in the first direction and causing a connection between the contact and the terminal to be made; and (e) moving the plunger in a second direction such that the plunger impacts the impact device and thereby moves the contact in a direction away from the terminal.

10. The method of claim 9 wherein a contact rod provides the communication between the impact device and the contact.

11. The method of claim 10 wherein the impact device is positioned at one end of the contact rod.

12. The method of claim 11 wherein the impact device is a knob.

13. The method of claim 11 wherein the plunger includes a slot for receiving the abutment pin.

14. The method of claim 13 wherein the impact device is bounded in the center cavity by the abutment pin and a shoulder formed in the plunger.

15. The method solenoid of claim 14 wherein the movement of the plunger in the second direction breaks the connection between the contact and the terminal.

16. A solenoid for making and breaking a connection between a contact and at least one terminal, the solenoid comprising:

(a) windings for receiving electric current, the windings positioned upon a bobbin;

(b) a plunger positioned to slide within the bobbin, the plunger including a center chamber formed axially within the plunger and an abutment pin traversing the center chamber, the center chamber including a shoulder which defines an axial bore extending from the exterior of the plunger to the center chamber, the plunger operable to move in a first direction when electric current is distributed to the windings and the plunger operable to move in a second direction when electric current is removed from the windings;

(c) a contact rod slideably engaging the axial bore of the plunger, the contact rod having a first end and a second end, one end of the contact rod including a knob positioned within the center chamber of the plunger and the second end of the contact rod supporting the contact, wherein movement of the plunger in the first direction causes the abutment pin positioned within the plunger to impact the knob of the contact rod and move the contact rod in the first direction and thereby establish a connection between the contact and the at least one terminal, and movement of the plunger in the second direction causes the shoulder of the plunger to impact the knob of the contact rod to move the contact rod in the second direction and thereby break the connection between the contact and the at least one terminal.

17. The solenoid of claim 16 wherein the plunger further includes at least one slot and the abutment pin positioned within the plunger is retained in the at least one slot.

18. A method of making and breaking a connection between a contact and terminals in a solenoid, the method comprising:

(a) providing windings for receiving electric current, the windings positioned upon a bobbin;

(b) providing a plunger positioned to slide within the bobbin, the plunger including a center chamber formed axially within the plunger and an abutment pin traversing the center chamber, the center chamber including a shoulder which defines an axial bore extending from the exterior of the plunger to the center chamber;

(c) providing a contact rod slideably engaging the axial bore of the plunger, the contact rod having a first end and a second end, one end of the contact rod including a knob positioned within the center chamber of the plunger and the second end of the contact rod supporting the contact;

(d) moving the plunger in a first direction further within the bobbin such that the knob of the contact rod strikes the abutment pin, causing the contact rod to also move in the first direction and bringing the contact into a connection with the terminals;

(e) moving the plunger in a second direction further removed from the bobbin such that the shoulder of the plunger impacts the knob of the contact rod to move the contact rod in the second direction and thereby break the connection between the contact and the terminals.

19. The method of claim 18 wherein the plunger further includes at least on e slot and the abutment pin positioned within the plunger is retained in the at least one slot.

20. A solenoid for making and breaking a connection between a contact and terminals, the solenoid comprising:

(a) a winding for receiving electric current;

(b) a moveable plunger positioned in electromagnetic communication with the winding, the moveable plunger including a center cavity, movement of the plunger in a first direction causing the connection between the contact and the terminals to be made, and movement of the plunger in a second direction causing the connection between the contact and the terminals to be broken;

(c) an abutment pin positioned in the center cavity of the plunger; and (d) an impact means for moving the contact, the impact means positioned to impact the abutment pin when the plunger moves in the first direction and the impact means positioned to impact the plunger when the plunger moves in the second direction and thereby break the connection between the contact and the terminals.

* * * * *